US011745973B2

(12) United States Patent
Yanai

(10) Patent No.: US 11,745,973 B2
(45) Date of Patent: Sep. 5, 2023

(54) POST-PROCESSING APPARATUS AND IMAGE FORMING SYSTEM INCORPORATING THE POST-PROCESSING APPARATUS

(71) Applicant: Yuta Yanai, Kanagawa (JP)

(72) Inventor: Yuta Yanai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/747,008

(22) Filed: May 18, 2022

(65) Prior Publication Data

US 2022/0380165 A1 Dec. 1, 2022

(30) Foreign Application Priority Data

May 28, 2021 (JP) ..... 2021-090166

(51) Int. Cl.
*B65H 37/04* (2006.01)

(52) U.S. Cl.
CPC ..... *B65H 37/04* (2013.01); *B65H 2301/4213* (2013.01); *B65H 2301/51611* (2013.01); *B65H 2408/122* (2013.01); *B65H 2801/06* (2013.01); *B65H 2801/27* (2013.01)

(58) Field of Classification Search
CPC ..... B65H 2408/122; B65H 2408/1222; B65H 2801/06; B65H 2801/27; B65H 2301/51611; B65H 2301/4213; B65H 37/04; G03G 2215/00827; G03G 2215/00848; B31F 5/001
USPC ..... 270/58.08
See application file for complete search history.

(56) References Cited

U.S. PATENT DOCUMENTS 5,797,596 A * 8/1998 Morigami ..... B65H 45/142 270/58.11
6,164,511 A * 12/2000 Chung ..... B42C 1/12 227/111
6,427,997 B1 * 8/2002 Hirota ..... B42C 1/12 270/58.12

(Continued)

FOREIGN PATENT DOCUMENTS

JP 8-133577 5/1996
JP 2009-012892 1/2009

OTHER PUBLICATIONS

Extended European Search Report dated Nov. 8, 2022 in European Patent Application No. 22172976.7, 5 pages.

*Primary Examiner* — Leslie A Nicholson, III
(74) *Attorney, Agent, or Firm* — XSENSUS LLP

(57) ABSTRACT

A post-processing apparatus includes a conveyor, a tray, a binder, and a binder mover. The conveyor conveys recording media on each of which an image is formed by an image forming apparatus. The tray holds the recording media conveyed by the conveyor. The binder binds the recording media on the tray with a plurality of staples in a cartridge. The binder mover includes a motor, a ratchet gear that receives a driving force of the motor to rotate in a forward direction or a reverse direction, a driving force transmitter that moves the binder toward one side in the main scanning direction as the ratchet gear rotates in the forward direction and moves the binder toward an opposite side in the main scanning direction as the ratchet gear rotates in the reverse direction, and a rotation limiter that moves between a rotation allowing position and a rotation limiting position.

5 Claims, 7 Drawing Sheets

(56) References Cited

U.S. PATENT DOCUMENTS

| | | | | |
|---|---|---|---|---|
| 6,565,076 | B2 * | 5/2003 | Kubota | B65H 45/18 227/4 |
| 10,087,034 | B2 * | 10/2018 | Awano | G03G 15/6544 |
| 10,481,544 | B2 * | 11/2019 | Yoshida | H04N 1/00639 |
| 11,112,744 | B2 * | 9/2021 | Sato | B65H 37/04 |
| 11,325,805 | B2 * | 5/2022 | Takahashi | B41L 43/12 |
| 2010/0117288 | A1 | 5/2010 | Taki et al. | |

* cited by examiner

POST-PROCESSING APPARATUS AND IMAGE FORMING SYSTEM INCORPORATING THE POST-PROCESSING APPARATUS

CROSS-REFERENCE TO RELATED APPLICATION

This patent application is based on and claims priority pursuant to 35 U.S.C. § 119(a) to Japanese Patent Application No. 2021-090166, filed on May 28, 2021, in the Japan Patent Office, the entire disclosure of which is hereby incorporated by reference herein.

BACKGROUND

Technical Field

Embodiments of the present disclosure relate to a post-processing apparatus and an image forming system incorporating the post-processing apparatus.

Background Art

In the related art, various post-processing apparatuses are known to include a tray that holds a bundle of sheets, and a binder that binds the bundle of sheets on the tray using a staple or staples. Hereinafter, the bundle of sheets is referred to as a "sheet bundle". The binder includes a cartridge to contain a plurality of staples and is movable along the sheet bundle held by the tray.

In such a post-processing apparatus, when the number of staples in the cartridge decreases, a user replenishes the cartridge with new staples. To avoid such an inconvenience, there is a technique for facilitating replenishment of staples by locking movement of a binder in conjunction with opening of a door.

SUMMARY

Embodiments of the present disclosure described herein provide a novel post-processing apparatus that includes a conveyor, a tray, a binder, and a binder mover. The conveyor conveys recording media on each of which an image is formed by an image forming apparatus. The tray holds the recording media conveyed by the conveyor. The binder includes a cartridge containing a plurality of staples. The binder binds the recording media on the tray with the plurality of staples in the cartridge. The binder mover moves the binder in a main scanning direction that is orthogonal to a conveyance direction of the recording media conveyed by the conveyor. The binder mover includes a motor, a ratchet gear, a driving force transmitter, and a rotation limiter. The ratchet gear receives a driving force of the motor to rotate in a forward direction or a reverse direction. The driving force transmitter moves the binder toward one side in the main scanning direction as the ratchet gear rotates in the forward direction and moves the binder toward an opposite side in the main scanning direction as the ratchet gear rotates in the reverse direction. The rotation limiter moves between a rotation allowing position at which the rotation limiter moves away from the ratchet gear to allow rotation in either of the forward direction and the reverse direction and a rotation limiting position at which the rotation limiter contacts the ratchet gear to allow rotation in the forward direction and restrict rotation in the reverse direction.

Further, embodiments of the present disclosure described herein provide an image forming system including an image forming apparatus that forms an image on a surface of each of recording media, and the above-described post-processing apparatus that binds the recording media each having the image formed by the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
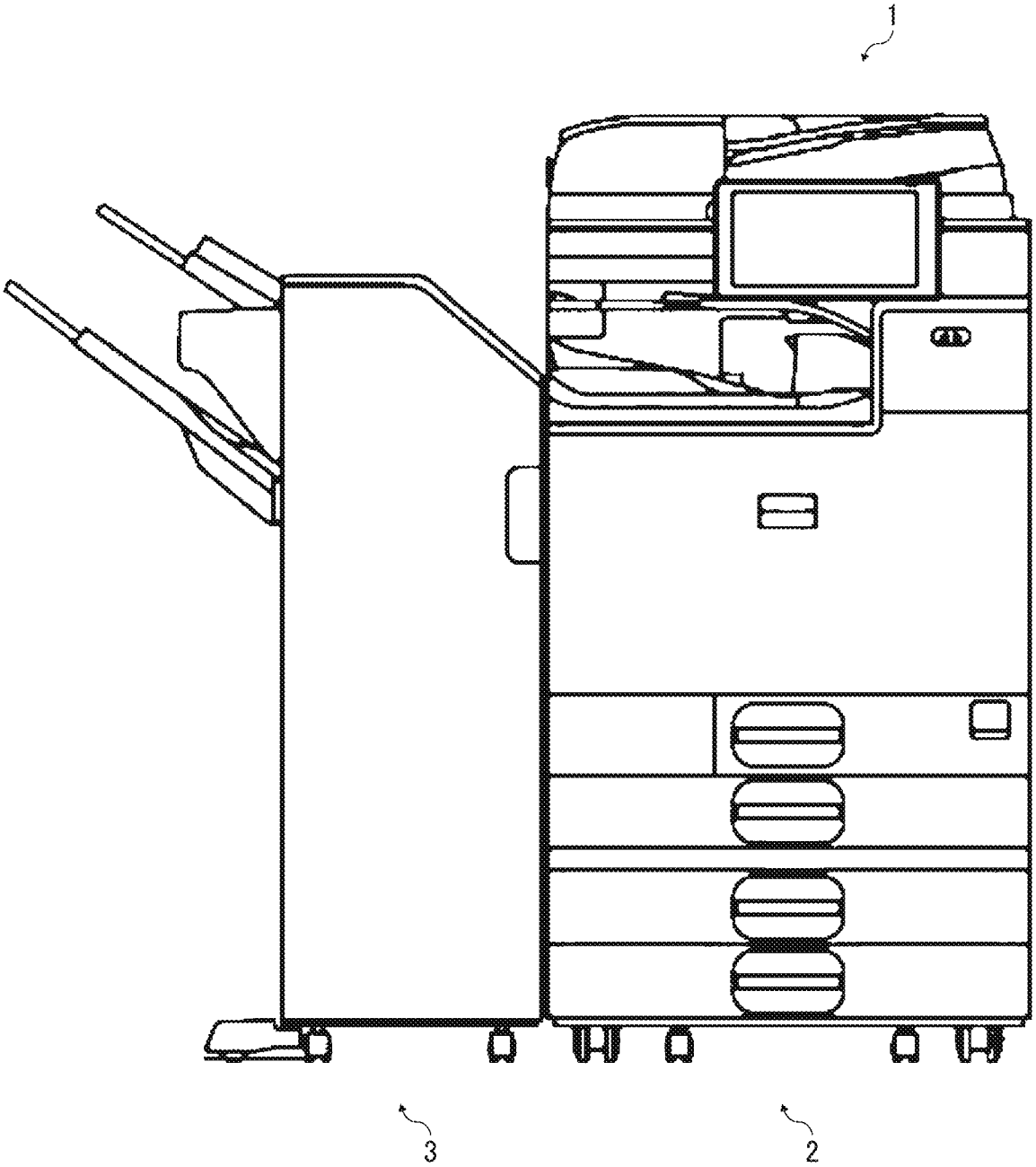
FIG. 1 is a diagram illustrating an overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Next, a description is given of a configuration and functions of a post-processing apparatus and an image forming system incorporating the post-processing apparatus, according to an embodiment of the present disclosure, with reference to drawings. Note that identical parts or equivalents are given identical reference numerals and redundant descriptions are summarized or omitted accordingly.

Embodiments of the present disclosure are described below with reference to the attached drawings.

Hereinafter, a description is given of an image forming system 1 according to an embodiment of the present disclosure, with reference to the drawings.

FIG. 1 is a diagram illustrating an overall configuration of the image forming system 1.

The image forming system 1 has a function of forming an image on a sheet and executing post-processing on the sheet on which the image is formed. As illustrated in FIG. 1, the image forming system 1 includes an image forming apparatus 2 and a post-processing apparatus 3.

The image forming apparatus 2 forms an image on a sheet (recording medium) and ejects the sheet having the image to the post-processing apparatus 3. The image forming apparatus 2 mainly includes a tray in which a sheet (sheets or recording media) is contained, a conveyor that conveys the sheet contained in the tray, and an image forming device that forms an image on the sheet conveyed by the conveyor. The image forming device may be an inkjet image forming device in which an image is formed with ink or an electrophotographic image forming device in which an image is formed with toner. Since the image forming apparatus 2 has a typical configuration, a detailed description of the configuration and functions of the image forming apparatus 2 is omitted.

Figure 2:
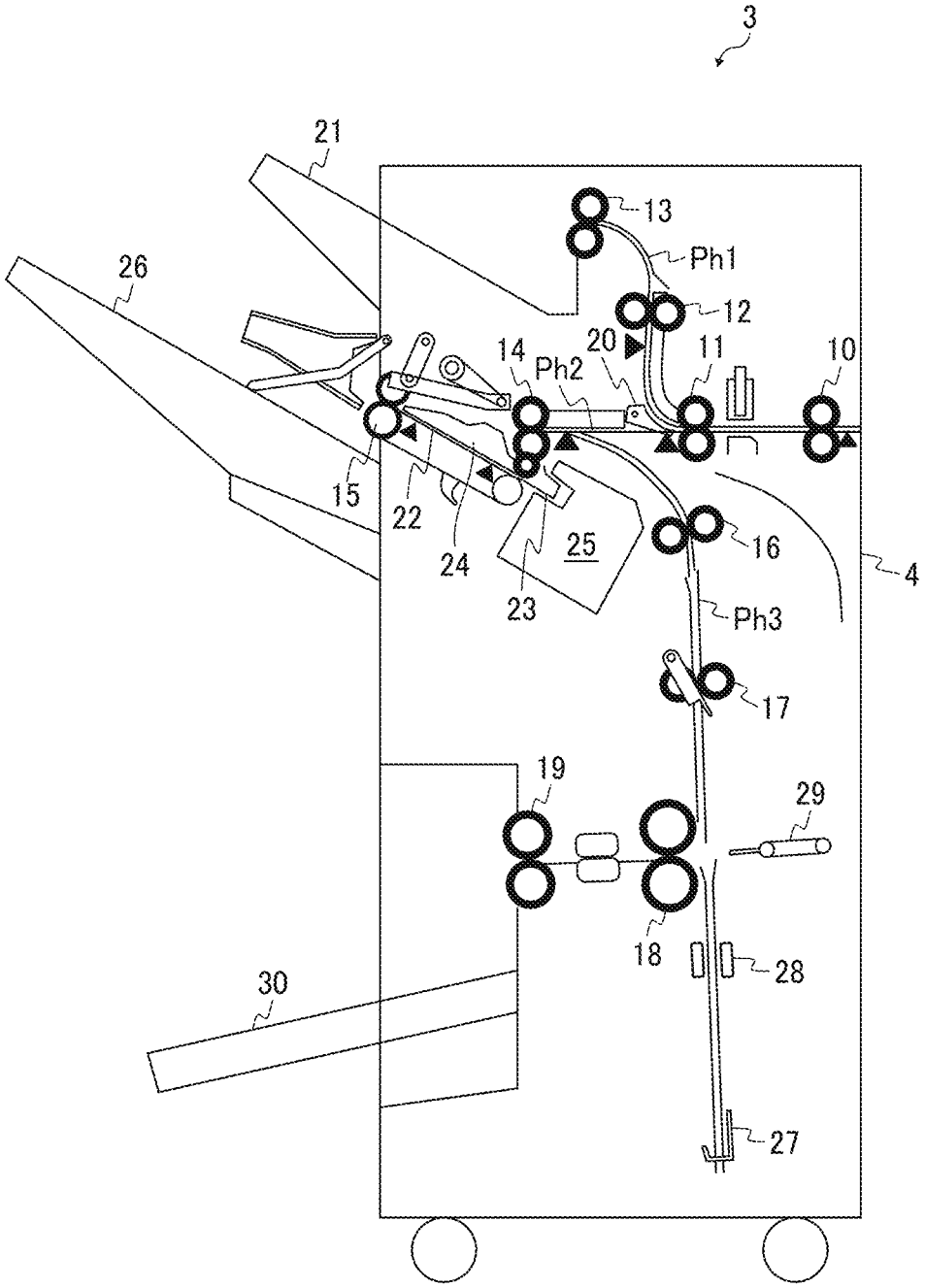
FIG. 2 is a diagram illustrating an internal configuration of a post-processing apparatus included in the image forming system of FIG. 1.

FIG. 2 is a diagram illustrating an internal configuration of the post-processing apparatus 3 included in the image forming system 1 of FIG. 1.

The post-processing apparatus 3 executes post-processing on the sheet on which the image is formed by the image forming apparatus 2. For example, the post-processing executed by the post-processing apparatus 3 according to the present embodiment includes a stapling process in which sheets each having an image on the surface are bound as a bundle of sheets ("sheet bundle") using staples. The stapling process includes an edge stitching process that binds an edge of each sheet bundle and a saddle stitching process that binds the center of the sheet bundle.

The post-processing apparatus 3 includes the conveyance roller pairs 10 to 19 each functioning as a conveyor and the switching claw 20. The conveyance roller pairs 10 to 19 convey the sheet fed from the image forming apparatus 2 so that the sheet travels inside the post-processing apparatus 3. More specifically, the conveyance roller pairs 10 to 13 convey the sheet along a first conveyance passage Ph1. The conveyance roller pairs 14 and 15 convey the sheet along a second conveyance passage Ph2. Further, the conveyance roller pairs 16 to 19 convey the sheet along a third conveyance passage Ph3.

The first conveyance passage Ph1 is a passage extending from a sheet supporting port from the image forming apparatus 2 to a sheet ejection tray 21. The second conveyance passage Ph2 is a passage branching from the first conveyance passage Ph1 between the conveyance roller pairs 11 and 14 in the conveyance direction of the sheet and extending to a sheet ejection tray 26 via the internal sheet tray 22. The third conveyance passage Ph3 is a passage branching from the first conveyance passage Ph1 between the conveyance roller pairs 11 and 14 in the conveyance direction of the sheet and extending to a sheet ejection tray 30.

The switching claw 20 is disposed at a branching position of the first conveyance passage Ph1 and the second conveyance passage Ph2. The switching claw 20 is switchable between a first position where the sheet is ejected to the sheet ejection tray 21 through the first conveyance passage Ph1 and a second position where the sheet conveyed through the first conveyance passage Ph1 is guided to the second conveyance passage Ph2. At the timing when the trailing end of the sheet entering the second conveyance passage Ph2 passes through the conveyance roller pair 11, the conveyance roller pair 14 is rotated in the reverse direction so that the sheet is guided to the third conveyance passage Ph3. The post-processing apparatus 3 further includes a plurality of sensors that detects the positions of the sheet in the first conveyance passage Ph1, the second conveyance passage Ph2, and the third conveyance passage Ph3. Each of the plurality of sensors is indicated by a black triangle mark in FIG. 2.

The post-processing apparatus 3 further includes a sheet ejection tray 21. The sheet ejection tray 21 holds the sheet ejected through the first conveyance passage Ph1. Among the sheets supplied from the image forming apparatus 2, sheets on which the stapling process is not executed are ejected to the sheet ejection tray 21.

The post-processing apparatus 3 includes the internal sheet tray 22, an end fence 23, side fences 24, a binder 25, and a sheet ejection tray 26. The internal sheet tray 22, the end fence 23, the side fences 24, and the binder 25 perform the edge stitching process on the sheet conveyed in the second conveyance passage Ph2. Among the sheets supplied from the image forming apparatus 2, a sheet bundle on which the edge stitching process is executed is ejected to the sheet ejection tray 26. Hereinafter, a direction from the conveyance roller pair 15 toward the end fence 23 is defined as a "sheet conveyance direction". A direction orthogonal to the vertical direction and the sheet conveyance direction is defined as a "main scanning direction (sheet width direction)".

The internal sheet tray 22 temporarily holds the sheets sequentially conveyed through the second conveyance passage Ph2. The end fence 23 aligns the position of the sheet bundle held on the internal sheet tray 22 in the sheet conveyance direction of the sheet bundle. The side fences 24 align the position of the sheet bundle held on the internal sheet tray 22 in the main scanning direction. The binder 25 binds an end of the sheet bundle aligned by the end fence 23 and the side fences 24. Then, the conveyance roller pair 15 ejects the sheet bundle subjected to the edge stitching process to the sheet ejection tray 26.

The post-processing apparatus 3 further includes an end fence 27, a binder 28, a sheet folding blade 29, and a sheet ejection tray 30. The end fence 27, the binder 28, and the sheet folding blade 29 perform a saddle stitching process on sheets conveyed through the third conveyance passage Ph3. Among the sheets supplied from the image forming apparatus 2, a sheet bundle on which the saddle stitching process is executed is ejected to the sheet ejection tray 30.

The end fence 27 aligns the positions of the sheet sequentially conveyed through the third conveyance passage Ph3 in the sheet conveyance direction of the sheet bundle. Further, the end fence 27 is movable between a binding position where the center of the sheet bundle faces the binder 28 and a folding position where the center of the sheet bundle faces the sheet folding blade 29. The binder 28 binds the center of the sheet bundle aligned by the end fence 27 at the binding position. The sheet folding blade 29 folds the sheet bundle in half while the sheet bundle is held on the end fence 27 at the folding position, and then brings the sheet bundle to the conveyance roller pair 18 so that the conveyance roller pair 18 nips the sheet bundle. Then, the conveyance roller pairs 18 and 19 eject the sheet bundle subjected to the saddle stitching process to the sheet ejection tray 30.

The post-processing apparatus 3 includes a box-shaped housing 4 having a plurality of walls including, for example, a top wall, a bottom wall, and side walls. The conveyance roller pairs 10 to 19, the switching claw 20, the internal sheet tray 22, the end fence 23 and 27, the side fences 24, the binders 25 and 28, and the sheet folding blade 29 are accommodated in an internal space of the housing 4 of the post-processing apparatus 3. The sheet ejection trays 21, 26, and 30 are supported by the housing 4 at respective positions exposed to the outside of the post-processing apparatus 3.

Figure 3:
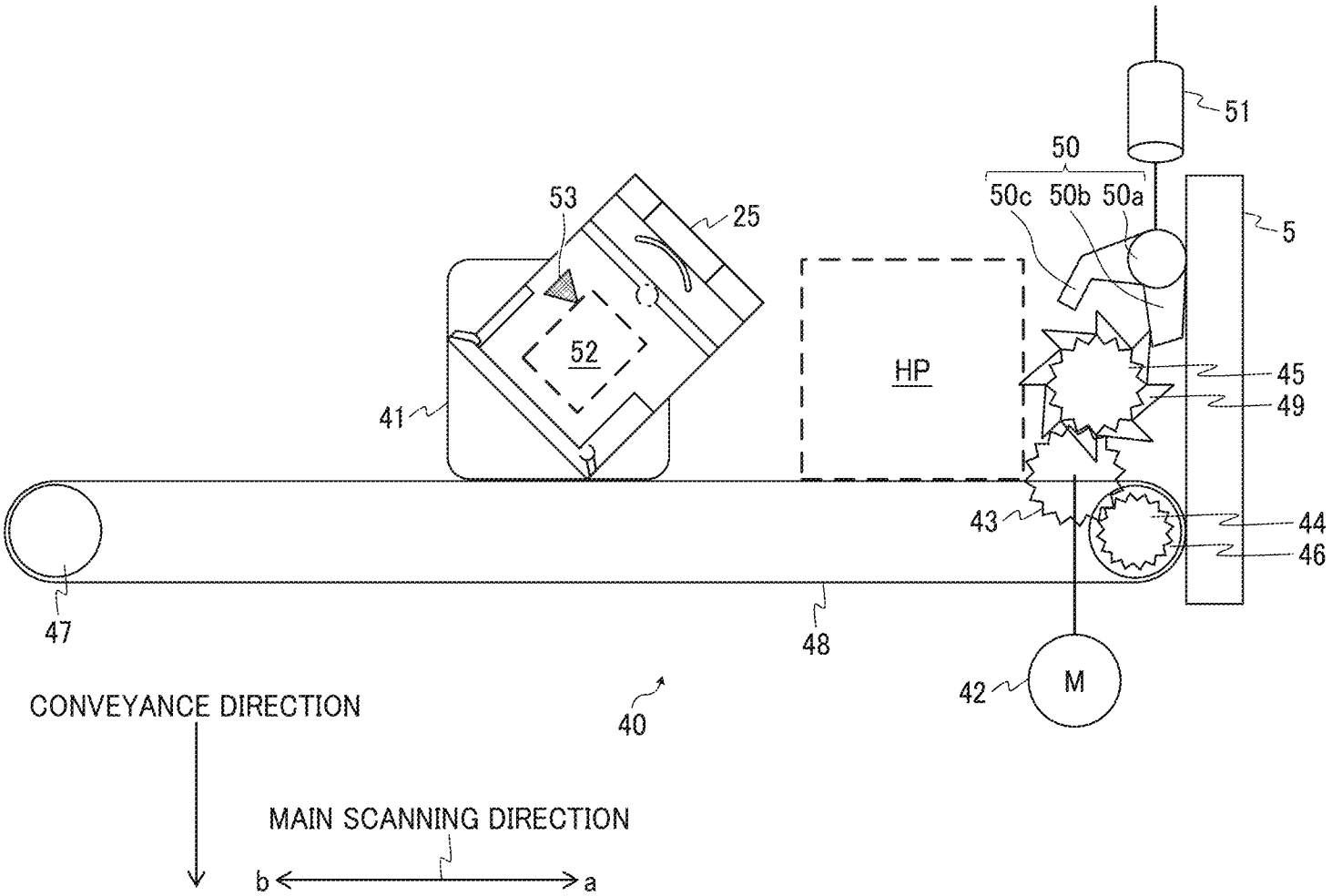
FIG. 3 is a diagram illustrating a moving mechanism with a cover closed.
Figure 4:
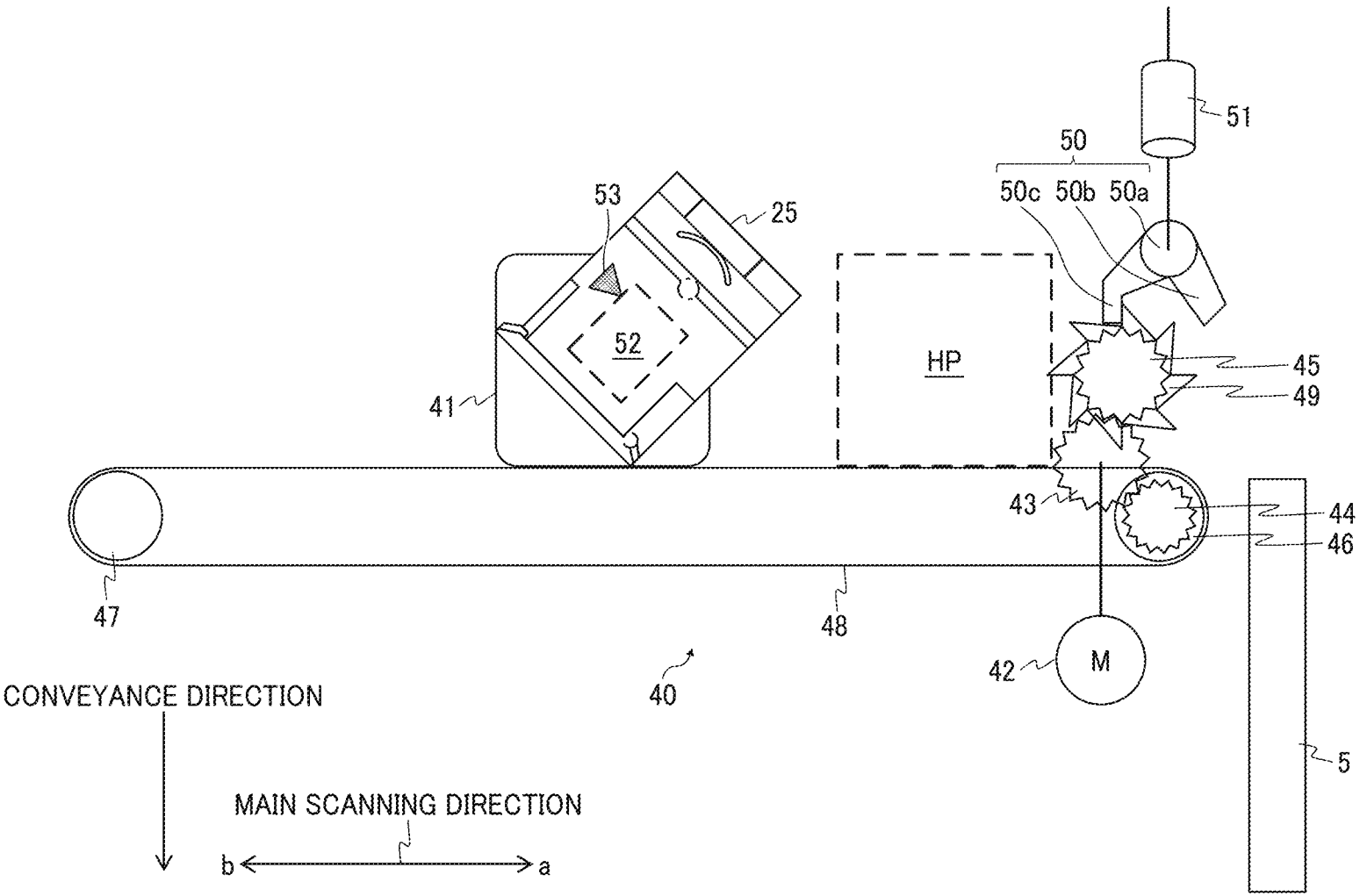
FIG. 4 is a diagram illustrating the moving mechanism with the cover open.

A cover 5 (see FIGS. 3 and 4) is attached to the housing 4. The cover 5 is openably and closably attached to, for example, a side wall of the housing 4. As an operator closes the cover 5, the opening of the housing 4 is closed. On the other hand, as the operator opens the cover 5, the opening of the housing 4 is exposed to bring the binder 25 and the moving mechanism 40 (see FIGS. 3 and 4) to be accessible. Note that the cover 5 in FIGS. 3 and 4 is a slidable cover. However, the method of opening and closing of the cover 5 is not limited to this example. As another example, the cover 5 may be rotatably supported by the housing 4 via a hinge.

Next, a description is given of a detailed configuration of the moving mechanism 40 that functions as a binder mover that moves the binder 25, with reference to FIGS. 3 and 4.

FIG. 3 is a diagram illustrating the moving mechanism 40 with the cover 5 closed.

FIG. 4 is a diagram illustrating the moving mechanism 40 with the cover 5 open.

The moving mechanism 40 moves the binder 25 in the main scanning direction along the outer edge of the sheet bundle that is held on the internal sheet tray 22. The moving mechanism 40 includes a support 41, a motor 42, spur gears 43, 44, and 45, pulleys 46 and 47, an endless loop belt 48, a ratchet gear 49, a rotation limiter 50, and a coil spring 51 (biasing member).

The support 41 rotatably supports the binder 25 around the axis orthogonal to each of the conveyance direction of the sheet and the main scanning direction. The support 41 is fixed to the endless loop belt 48. In other words, the binder 25 that is supported by the support 41 is movable in the main scanning direction in accordance with the rotation of the endless loop belt 48. Note that, in the moving range of the binder 25 in the main scanning direction, a position closest to the cover 5, i.e., an opening formed in the housing 4, is referred to as a "home position (HP)" and any position supported by a controller 100 (see FIG. 5) is referred to as a "binding position". A detailed description of the controller 100 is given below.

The motor 42 generates a driving force for moving the binder 25. The driving force of the motor 42 is transmitted to the binder 25 supported by the support 41, via the spur gears 43 to 45, the pulleys 46 and 47, and the endless loop belt 48. The spur gears 43 to 45, the pulleys 46 and 47, and the endless loop belt 48 are included in a drive transmitter.

The spur gear 43 is attached to the output shaft of the motor 42. Each of the spur gears 44 and 45 is meshed with the spur gear 43. The pulley 46 rotates together with the spur gear 44. The pulley 47 is spaced apart from the pulley 46 in the main scanning direction. The endless loop belt 48 is wound around the pulleys 46 and 47. In other words, as the driving force of the motor 42 is transmitted to the endless loop belt 48 via the spur gears 43 and 44 and the pulley 46, the endless loop belt 48 rotates around the pulleys 46 and 47. As a result, the binder 25 supported by the support 41 moves in the main scanning direction.

The ratchet gear 49 rotates together with the spur gear 45. The teeth formed on the outer circumferential face of the ratchet gear 49 have different angles of inclination on both sides in the circumferential direction, more specifically, different angles of inclination with respect to the forward direction. In the present embodiment, the angle of inclination of the forward face of the ratchet gear 49 when the ratchet gear 49 rotates clockwise (hereinafter, referred to as a "normal rotation") is greater than the angle of inclination of the forward face of the ratchet gear 49 when the ratchet gear 49 rotates counterclockwise (hereinafter, referred to as a "reverse direction").

The rotation limiter 50 includes a support shaft 50*a*, a contact portion 50*b*, and a restricting portion 50*c*. The contact portion 50*b* and the restricting portion 50*c* protrude radially outward from the support shaft 50*a* at different positions in the circumferential direction of the support shaft 50*a*. The rotation limiter 50 is rotatable about the support shaft 50*a* between a rotation allowing position as illustrated in FIG. 3 and a rotation limiting position as illustrated in FIG. 4. The coil spring 51 biases the rotation limiter 50 toward the rotation limiting position.

As illustrated in FIG. 3, the contact portion 50*b* contacts the cover 5 when the cover 5 is closed. As a result, the rotation limiter 50 changes (rotates) from the rotation limiting position to the rotation allowing position against the biasing force of the coil spring 51. On the other hand, as illustrated in FIG. 4, the contact portion 50*b* is separated from the cover 5 when the cover 5 is opened. As a result, the rotation limiter 50 changes (rotates) from the rotation allowing position to the rotation limiting position due to the biasing force of the coil spring 51. In other words, the rotation limiter 50 changes to the rotation allowing position in conjunction with closing of the cover 5 and changes to the rotation limiting position in conjunction with opening of the cover 5.

As illustrated in FIG. 3, when the rotation limiter 50 is in the rotation allowing position, the restricting portion 50*c* is located at a position where the restricting portion 50*c* does not contact the teeth of the ratchet gear 49. In other words, the rotation limiter 50 at the rotation allowing position allows normal rotation and reverse rotation of the ratchet gear 49.

On the other hand, as illustrated in FIG. 4, when the rotation limiter 50 is at the rotation limiting position, the restricting portion 50*c* is located at a position at which the restricting portion 50*c* comes into contact with the teeth of the ratchet gear 49. At this time, when the ratchet gear 49 starts normal rotation, the teeth having greater contact angles are brought to contact with the restricting portion 50*c*, so that the teeth of the ratchet gear 49 climb over the restricting portion 50*c*. As a result, the normal rotation of the ratchet gear 49 is allowed. On the other hand, when the ratchet gear 49 starts reverse direction, the teeth having smaller contact angles are brought to contact with the restricting portion 50*c*, so that the teeth of the ratchet gear 49 cannot climb over the restricting portion 50*c*. As a result, the reverse rotation of the ratchet gear 49 is restricted. In other words, the rotation limiter 50 at the rotation limiting position allows the normal rotation of the ratchet gear 49 and restricts the reverse rotation of the ratchet gear 49.

The moving direction of the binder 25 is interlocked with the rotational direction of the ratchet gear 49. In other words, the binder 25 moves to one side in the main scanning direction indicated by arrow "a" in FIGS. 3 and 4, along with the normal rotation of the ratchet gear 49. In other words, the binder 25 moves to one side in the main scanning direction regardless of the position of the rotation limiter 50. In the present embodiment, "one side in the main scanning direction" represents a side to which the binder 25 approaches the cover 5, in other words, a side to which the binder 25 approaches the opening formed in the housing 4.

On the other hand, the binder 25 moves to the opposite side in the main scanning direction indicated by arrow "b" in FIGS. 3 and 4 along with the reverse rotation of the ratchet gear 49. In other words, the binder 25 is movable to the opposite side in the main scanning direction when the rotation limiter 50 is at the rotation allowing position and is not movable to the opposite side in the main scanning direction when the rotation limiter 50 is at the rotation limiting position. In this embodiment, the "opposite side in the main scanning direction" represents a side to which the binder 25 moves away from the cover 5, in other words, a side to in which the binder 25 moves away from the opening formed in the housing 4.

Further, the binder 25 includes a cartridge 52 and a remaining amount sensor 53. The cartridge 52 contains a plurality of staples. The binder 25 binds the sheet bundle held on the internal sheet tray 22 using staples contained in the cartridge 52. A user may replenish staples into the cartridge 52. The remaining amount sensor 53 detects a remaining amount of staples contained in the cartridge 52 or detects whether staples remain in the cartridge 52, and outputs a remaining amount signal indicating the detection result to the controller 100. The remaining amount sensor 53 is achieved by a known sensor such as a mechanical sensor or an optical sensor.

Figure 5:
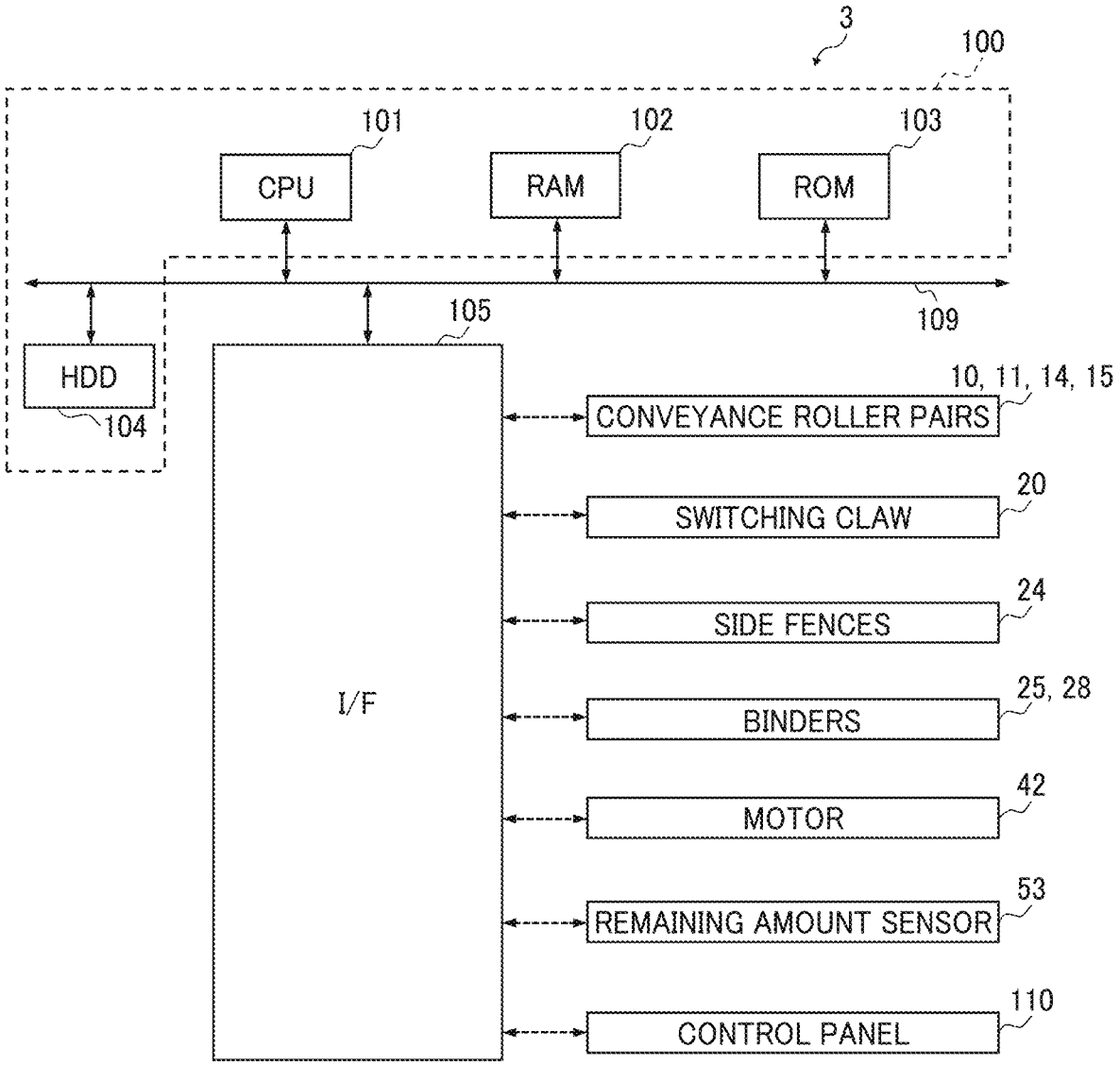
FIG. 5 is a schematic block diagram illustrating a hardware configuration of the post-processing apparatus of FIG. 2.

FIG. 5 is a schematic block diagram illustrating a hardware configuration of the post-processing apparatus 3.

As illustrated in FIG. 5, the post-processing apparatus 3 includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected each other via a common bus 109.

The CPU 101 is an arithmetic unit and controls the operation of the overall operation of the post-processing apparatus 3. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, e.g., an operating system (OS), various control programs, and application programs.

The post-processing apparatus 3 processes, by an arithmetic function of the CPU 101, e.g., a control program stored in the ROM 103 and an information processing program (or application program) loaded into the RAM 102 from a storage medium such as the HDD 104. Such processing configures a software controller including various functional modules of the post-processing apparatus 3. The software controller thus configured cooperates with hardware resources of the post-processing apparatus 3 construct functional blocks to implement functions of the post-processing apparatus 3. In other words, the CPU 101, the RAM 102, the ROM 103, and the HDD 104 implement the controller 100 that controls the operation of the post-processing apparatus 3.

The I/F 105 is an interface that connects the conveyance roller pairs 10, 11, 14, and 15, the switching claw 20, the side fences 24, the binders 25 and 28, the motor 42, the remaining amount sensor 53, and a control panel 110, to the common bus 109. The controller 100 drives the conveyance roller pairs 10, 11, 14, and 15, the switching claw 20, the side fences 24, the binders 25 and 28, and the motor 42, via the I/F 105. Although FIG. 5 illustrates the components that execute the edge stitching process, the components that execute the saddle stitching process are also similarly controlled by the controller 100.

The control panel 110 includes an operation unit that receives an operation instruction from the user and a display (notification unit) that notifies the user of information. The operation unit includes, for example, hard keys and a touch panel superimposed on a display. The control panel 110 acquires information from the user through the operation unit and provides the information to the user through the display. Note that a specific example of the notification unit is not limited to the display and may be an LED lamp or a speaker.

Figure 6:
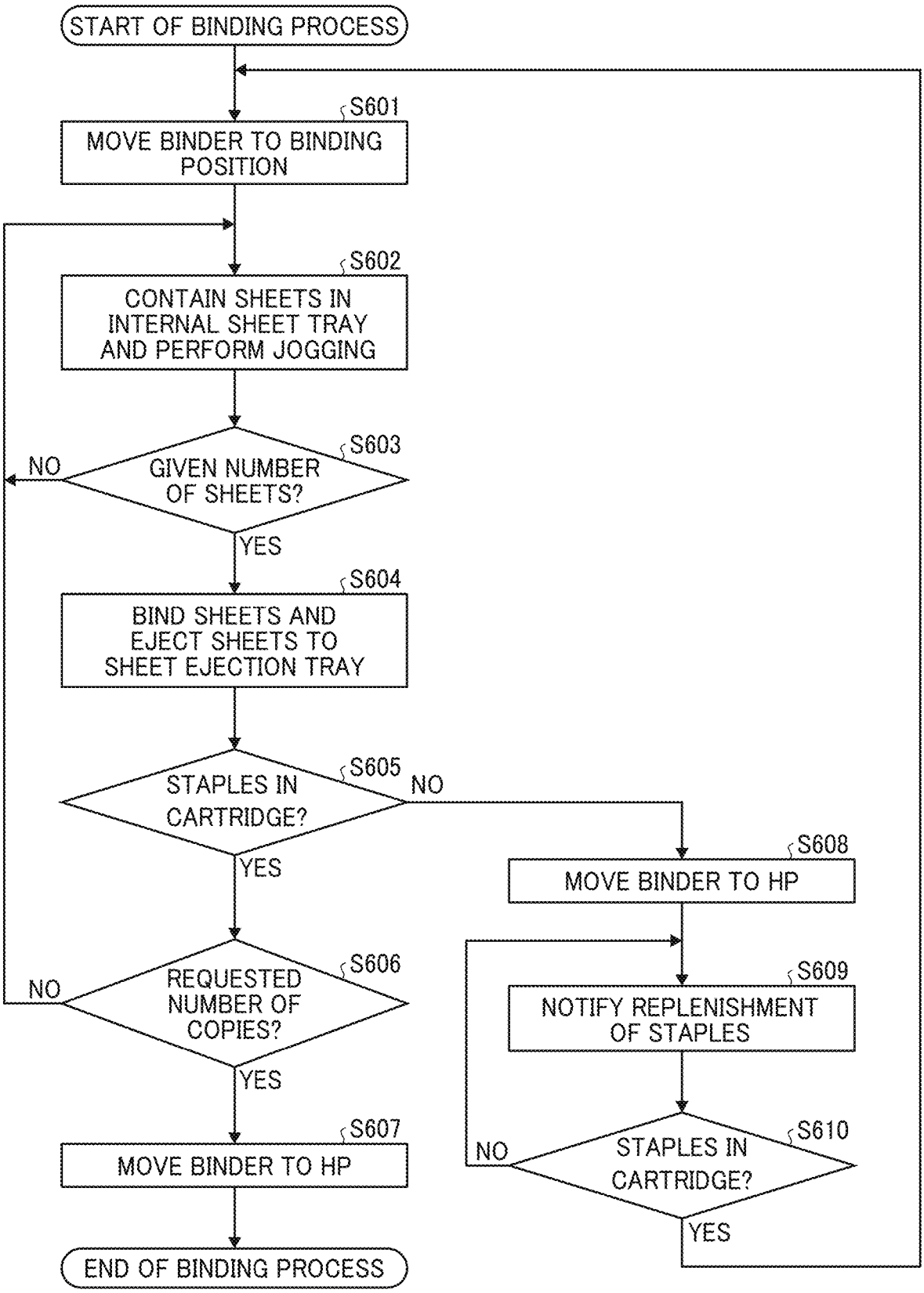
FIG. 6 is a flowchart of a stapling process.

FIG. 6 is a flowchart of a stapling process.

The controller 100 starts the stapling process illustrated in FIG. 6, for example, at a timing when an instruction to execute the stapling process (hereinafter, referred to as a "stapling command") is acquired from the image forming apparatus 2. The stapling command includes, for example, the number of sheets included in the sheet bundle (hereinafter referred to as a "given number of sheets") and the number of sheet bundles on which the stapling process is executed (hereinafter referred to as a "requested number of copies"). At the start of the stapling process, it is assumed that the cover 5 is closed, the binder 25 is located at the HP, and the cartridge 52 contains staples.

First, the controller 100 causes the binder 25 to move to the binding position (step S601). The binding position is a position at which the sheet bundle held on the internal sheet tray 22 is bound with the staples. The binding position may be included in the stapling command or may be instructed by a user via the control panel 110. The controller 100 may grasp the position of the binder 25 by an encoder sensor that is attached to, for example, the output shaft of the motor 42.

Then, the controller 100 causes the conveyance roller pairs 10, 11, 14, and 15 to rotate, so that the sheet on which the image is formed by the image forming apparatus 2 is stacked (held) in the internal sheet tray 22 (step S602). Further, the controller 100 causes the side fences 24 to move to align (jog) the position of the sheet bundle held on the internal sheet tray 22 in the main scanning direction (jogging). Next, the controller 100 determines whether or not the number of sheets stacked (held) in the internal sheet tray 22 reaches the given number of sheets indicated by the stapling command (step S603).

When the controller 100 determines that the number of sheets stacked (held) in the internal sheet tray 22 does not reach the given number of sheets (NO in step S603), the controller 100 executes the process of step S602 again. On the other hand, when the controller 100 determines that the number of sheets stacked (held) in the internal sheet tray 22 reaches the given number of sheets (YES in step S603), the controller 100 executes the edge stitching process on the sheet bundle in the internal sheet tray 22, and then cause the sheet bundle to be ejected to the sheet ejection tray 26 (step S604).

To be more specific, the controller 100 drives the binder 25 at the binding position to bind the sheet bundle contained in the internal sheet tray 22 with the staples contained in the cartridge 52. Next, the controller 100 causes the conveyance roller pair 15 to rotate so as to eject the sheet bundle subjected to the edge stitching process, to the sheet ejection tray 26.

Next, the controller 100 determines whether or not the staples are contained in the cartridge 52 based on the remaining amount signal output from the remaining amount sensor 53 (step S605). When the controller 100 determines that the staples are contained in the cartridge 52 (YES in step S605), the controller 100 determines whether or not the number of sheet bundles ejected to the sheet ejection tray 26 reaches the requested number of copies indicated by the stapling command (step S606).

Next, when the controller 100 determines that the number of sheet bundles ejected to the sheet ejection tray 26 has not reached the requested number of copies indicated by the stapling command (NO in step S606), the controller 100 executes the processing of step S602 and subsequent steps again. On the other hand, when the controller 100 determines that the number of sheet bundles ejected to the sheet ejection tray 26 reached the requested number of copies indicated by the stapling command (YES in step S606), the controller 100 causes the binder 25 to move to the home position (HP) (step S607). Then, the stapling process ends. In other words, when the controller 100 determines that the number of sheet bundles ejected to the sheet ejection tray 26 has not reached the requested number of copies indicated by the stapling command (NO in step S606), the controller 100 repeatedly executes the processing of steps S602 to S605 until the number of sheet bundles ejected to the sheet ejection tray 26 reaches the requested number of copies.

Each time the processing of step S604 is executed, the number of staples contained in the cartridge 52 decreases. In the process of repeating steps S602 to S605, when the controller 100 determines that the staples are not contained in the cartridge 52 (NO in step S605), the controller 100 executes the processing of steps S608 to 610, so as to prompt a user to replenish staples into the cartridge 52.

First, the controller 100 causes the binder 25 to move to the HP (step S608). At this time, since the cover 5 is closed, in other words, since the rotation limiter 50 is at the rotation allowing position, the rotation limiter 50 is movable to either side in the main scanning direction.

Next, the controller 100 displays, on the display, a message prompting replenish of staples into the cartridge 52 (step S609). Then, the controller 100 determines whether the remaining amount sensor 53 detects the presence of staples in the cartridge 52 (step S610). When the controller 100 determines that the remaining amount sensor 53 does not detect the presence of staples in the cartridge 52 (NO in step S610), the controller 100 continues to display the message on the display until the remaining amount sensor 53 detects the presence of the staples. In addition, the notification method is not limited to displaying a message and may be lighting of a light-emitting diode (LED) lamp or an output of a guide sound through a speaker.

The user who notices this message opens the cover 5 and replenishes the cartridge 52 with staples. At this time, the position of the rotation limiter 50 to the rotation limiting position is changed, so that the binder 25 is restricted to move in the direction away from the cover 5. On the other hand, when a jam occurs in the binder 25 and the binder 25 cannot be moved to the HP, the user may move the binder 25 to the HP manually.

Then, when the controller 100 determines that the staples are contained in the cartridge 52 (YES in step S610), the controller 100 causes the teeth of the staples contained in the cartridge 52 to be protruded (self-priming), and then executes steps S601 and subsequent steps again.

According to the above-described embodiment, the following operational effects, for example, are achieved.

According to the above-described embodiment, the change of position of the rotation limiter 50 to the rotation limiting position restricts movement of the binder 25 in the direction away from the cover 5, that is, to the opposite side in the main scanning direction. This configuration prevents movement of the binder 25 to the far side of the housing 4 when staples are replenished into the cartridge 52. In addition, even when a jam occurs in the binder 25 inside the housing 4, the binder 25 is manually moved toward the cover 5, in other words, toward the one side in the main scanning direction. As a result, the operation of replenishing staples into the cartridge 52 is facilitated.

In addition, according to the above-described embodiment, the position of the rotation limiter 50 changes in conjunction with opening and closing of the cover 5. This configuration reduces the number of parts to cause the rotation limiter 50 to change the position and simplifies the operation to replenish staples into the cartridge 52. However, a specific method of changing the position of the rotation limiter 50 is not limited to the above-described example.

Further, according to the above-described embodiment, by opening the cover 5, the rotation limiter 50 automatically returns to the rotation allowing position due to the biasing force of the coil spring 51. Due to such configurations as described above, the operation of replenishing the cartridge 52 with staples is further simplified.

Note that an electronic component such as a solenoid may be used to change the position of the rotation limiter 50. However, such a method causes a new inconvenience that power consumption of the post-processing apparatus 3 increases. Therefore, as in the above-described embodiment, the position of the rotation limiter 50 is changed in conjunction with the opening and closing of the cover 5 (in other words, without using an electronic component such as a solenoid), thereby contributing to power saving of the post-processing apparatus 3.

Note that the detailed configuration of the moving mechanism 40 is not limited to the examples illustrated in FIGS. 3 and 4.

Figure 7:
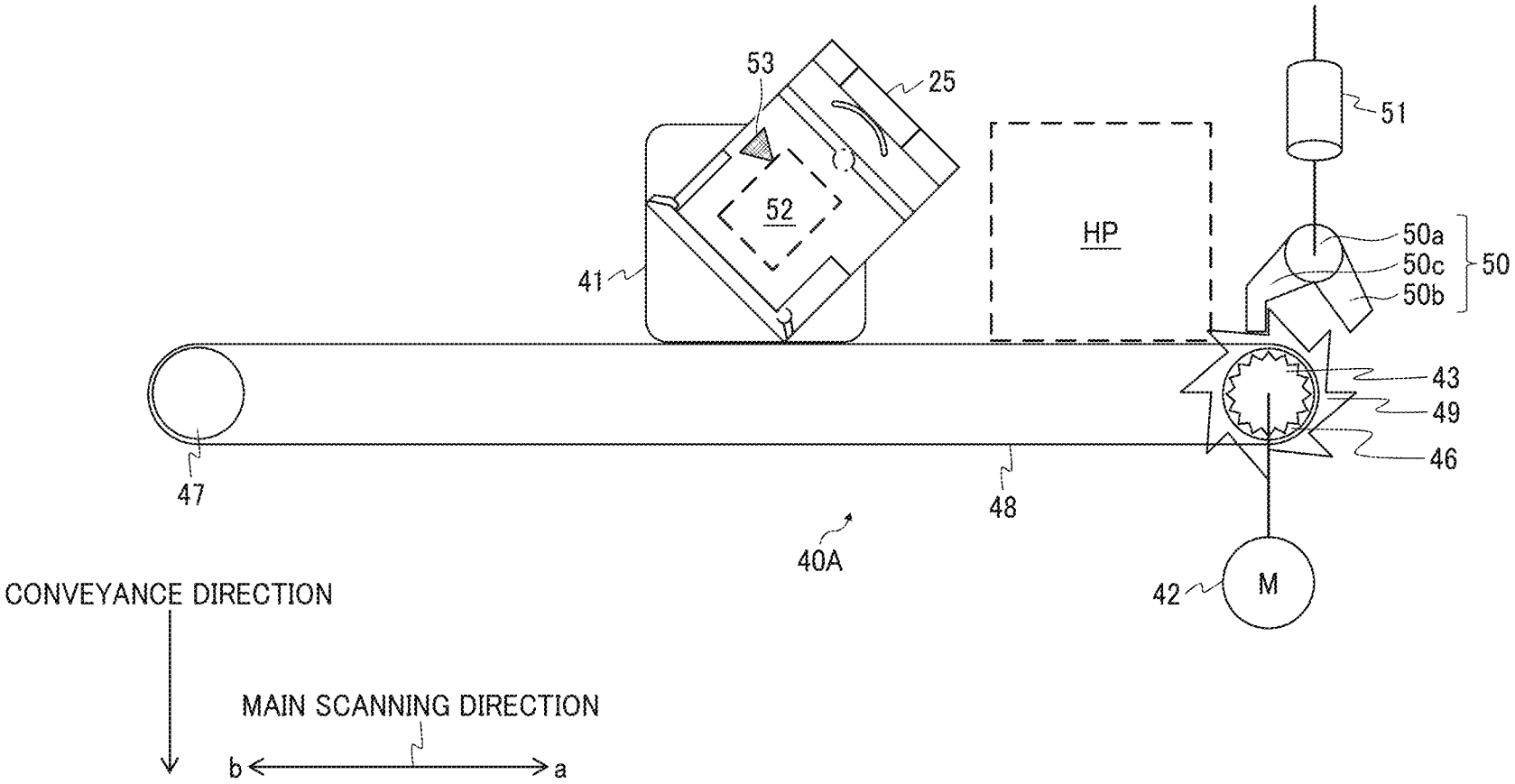
FIG. 7 is a diagram illustrating a modification of the moving mechanism.

FIG. 7 is a diagram illustrating a moving mechanism 40A according to a modification of the present embodiment.

The moving mechanism 40A illustrated in FIG. 7 is different from the moving mechanism 40 illustrated in FIGS. 3 and 4 in that the spur gears 44 and 45 are omitted in the moving mechanism 40A illustrated in FIG. 7. The spur gear 43 attached to the output shaft of the motor 42 rotates together with the pulley 46 and the ratchet gear 49 as a single unit. In order to transmit the driving force of the motor 42 to the endless loop belt 48 and the ratchet gear 49, any number of spur gears or belts may be used.

Further, the embodiments and modifications described above provide an example in which each of the moving mechanisms 40 and 40A moves the binder 25 that executes the edge stitching process. Alternatively, the moving mechanisms 40 and 40A may be applied to move the binder 28 that executes the saddle stitching process.

The control method described above may be implemented by, for example, a program. That is, the control method may be executed by causing an arithmetic device, a storage device, an input device, an output device, and a control device to operate in cooperation with each other based on a program. In addition, the program may be written in, for example, a storage device or a storage medium and distributed, or may be distributed through, for example, an electric communication line.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

What is claimed is:

1. A post-processing apparatus comprising:

a conveyor configured to convey recording media on each of which an image is formed by an image forming apparatus;

a tray configured to hold the recording media conveyed by the conveyor;

a binder including a cartridge containing a plurality of staples, the binder being configured to bind the recording media on the tray with the plurality of staples in the cartridge; and a binder mover configured to move the binder in a main scanning direction that is orthogonal to a conveyance direction of the recording media conveyed by the conveyor, the binder mover including:

a motor;

a ratchet gear configured to receive a driving force of the motor to rotate in a forward direction or a reverse direction;

a driving force transmitter configured to move the binder toward one side in the main scanning direction as the ratchet gear rotates in the forward direction and move the binder toward an opposite side in the main scanning direction as the ratchet gear rotates in the reverse direction; and a rotation limiter configured to move between a rotation allowing position at which the rotation limiter moves away from the ratchet gear to allow rotation in either of the forward direction and the reverse direction and a rotation limiting position at which the rotation limiter contacts the ratchet gear to allow rotation in the forward direction and restrict rotation in the reverse direction.

2. The post-processing apparatus according to claim 1, further comprising:

a housing containing the conveyor, the tray, the binder, and the binder mover; and a cover rotatably supported by the housing, wherein the rotation limiter is configured to:

change to the rotation allowing position in conjunction with closing of the cover; and change to the rotation limiting position in conjunction with opening of the cover.

3. The post-processing apparatus according to claim 2, wherein the binder is configured to approach the cover toward the one side in the main scanning direction.

4. The post-processing apparatus according to claim 2, wherein the binder mover includes a biasing member applying a biasing force to bias the rotation limiter toward the rotation limiting position, wherein the rotation limiter is configured to:

contact the cover when the cover is closed and change to the rotation allowing position against the biasing force of the biasing member; and move away from the cover when the cover is open and change to the rotation limiting position due to the biasing force of the biasing member.

5. An image forming system comprising:

an image forming apparatus configured to form an image on a surface of each of recording media; and the post-processing apparatus according to claim 1, configured to bind the recording media each having the image formed by the image forming apparatus.

* * * * *